US008991660B2

(12) United States Patent
Hair et al.

(10) Patent No.: US 8,991,660 B2
(45) Date of Patent: Mar. 31, 2015

(54) SQUEEZE BOTTLE FOR SINUS CAVITY RINSE

(75) Inventors: Kenneth A. Hair, Fort Collins, CO (US); Kurt M. Taylor, Fort Collins, CO (US)

(73) Assignee: Water Pik, Inc., Fort Collins, CO (US)

( * ) Notice: Subject to any disclaimer, the term of this patent is extended or adjusted under 35 U.S.C. 154(b) by 756 days.

(21) Appl. No.: 12/970,415

(22) Filed: Dec. 16, 2010

(65) Prior Publication Data

US 2011/0139826 A1 Jun. 16, 2011

Related U.S. Application Data

(63) Continuation-in-part of application No. 29/352,093, filed on Dec. 16, 2009, now Pat. No. Des. 653,953, and a continuation-in-part of application No. 29/352,100, filed on Dec. 16, 2009, now Pat. No. Des. 634,630, and (Continued)

(51) Int. Cl.
*B65D 37/00* (2006.01)
*B65D 1/32* (2006.01)

(52) U.S. Cl.
CPC ..... *B65D 1/32* (2013.01)
USPC ..... 222/211; 222/422; 222/420; 222/213; 222/214; 222/421

(58) Field of Classification Search
USPC ..... 222/420–422, 207, 211–214
See application file for complete search history.

(56) References Cited

U.S. PATENT DOCUMENTS

| | | | |
|---|---|---|---|
| 465,559 | A | 12/1891 | Good |
| 2,115,959 | A | 5/1938 | Lewis |
| 2,571,921 | A | 10/1951 | Morris |
| 2,578,864 | A | 12/1951 | Tupper |
| D169,996 | S | 7/1953 | Vuillement |

(Continued)

FOREIGN PATENT DOCUMENTS

| | | |
|---|---|---|
| DE | 29602605 | 4/1996 |
| GB | 881807 | 10/1958 |

(Continued)

OTHER PUBLICATIONS

International Search Report, PCT/US2010/060820, 2 pages, Feb. 16, 2011.

(Continued)

*Primary Examiner* — J. Casimer Jacyna
*Assistant Examiner* — Jeremy W Carroll
(74) *Attorney, Agent, or Firm* — Dorsey & Whitney LLP

(57) ABSTRACT

A vessel for use in rinsing a user's nasal cavity provides a resiliently collapsible main body, a self-sealing nozzle that increases in internal pressure when the vessel is squeezed, and a check valve in the nozzle to reduce back-wash into the vessel. A collar connects the nozzle and check valve to the main body. The check valve includes a first opening that provides fluid communication between the main body and a void formed in an interior of the nozzle and may allow pressure within the nozzle to increase upon deforming the main body. A second opening may provide fluid communication between an exterior of the main body and a fluid reservoir formed in the main body. The second opening may cooperate with a valve that allows selective fluid communication between the exterior of the main body and the reservoir formed in the main body.

24 Claims, 10 Drawing Sheets

Related U.S. Application Data a continuation-in-part of application No. 29/352,101, filed on Dec. 16, 2009, now Pat. No. Des. 634,631, and a continuation-in-part of application No. 29/634,669, filed on Jun. 25, 2010, now Pat. No. Des. 676,125.

(60) Provisional application No. 61/287,016, filed on Dec. 16, 2009, provisional application No. 61/369,378, filed on Jul. 30, 2010.

(56) References Cited

U.S. PATENT DOCUMENTS

| | | | | | |
|---|---|---|---|---|---|
| 2,722,458 | A | | 11/1955 | Wahlin | |
| 2,811,283 | A | | 10/1957 | Bowen | |
| 2,987,261 | A | | 6/1961 | McCuiston et al. | |
| 3,176,883 | A | * | 4/1965 | Davis, Jr. | 222/633 |
| 3,363,808 | A | | 1/1968 | Gorman | |
| 3,455,294 | A | | 7/1969 | Adler et al. | |
| 3,820,532 | A | | 6/1974 | Eberhardt et al. | |
| 3,847,145 | A | | 11/1974 | Grossan | |
| 4,083,840 | A | | 4/1978 | Schoefberger | |
| D250,546 | S | | 12/1978 | Pick et al. | |
| D250,601 | S | | 12/1978 | Pick et al. | |
| 4,179,051 | A | | 12/1979 | Thomas | |
| 4,356,941 | A | | 11/1982 | McRoskey et al. | |
| D271,028 | S | | 10/1983 | Adams | |
| 4,410,110 | A | | 10/1983 | Del Bon et al. | |
| 4,432,496 | A | * | 2/1984 | Ito | 239/327 |
| 4,439,206 | A | | 3/1984 | Hildebrand et al. | |
| 4,489,535 | A | | 12/1984 | Veltman | |
| 4,513,891 | A | | 4/1985 | Hain et al. | |
| 4,526,797 | A | | 7/1985 | Stone, Jr. | |
| 4,555,469 | A | | 11/1985 | Erdmann et al. | |
| 4,760,937 | A | | 8/1988 | Evezich | |
| 4,828,149 | A | * | 5/1989 | Hester | 222/207 |
| D305,262 | S | | 12/1989 | Nichols | |
| 4,925,128 | A | | 5/1990 | Brody | |
| D314,702 | S | | 2/1991 | Gonzalez | |
| D317,940 | S | | 7/1991 | Brenner | |
| 5,110,051 | A | * | 5/1992 | Bennett | 239/327 |
| 5,125,543 | A | * | 6/1992 | Rohrabacher et al. | 222/211 |
| 5,127,553 | A | * | 7/1992 | Weinstein | 222/158 |
| 5,183,186 | A | * | 2/1993 | Delaney, Jr. | 222/211 |
| 5,301,846 | A | | 4/1994 | Schmitz | |
| 5,316,054 | A | | 5/1994 | Hall et al. | |
| 5,328,099 | A | * | 7/1994 | Petit et al. | 239/372 |
| 5,330,634 | A | | 7/1994 | Wong et al. | |
| 5,354,849 | A | | 10/1994 | Schoefberger | |
| 5,505,193 | A | * | 4/1996 | Ballini et al. | 128/200.15 |
| RE35,354 | E | * | 10/1996 | Kersten et al. | 222/209 |
| 5,570,966 | A | | 11/1996 | Phelan | |
| 5,611,376 | A | | 3/1997 | Chuang | |
| 5,649,530 | A | | 7/1997 | Ballini | |
| 5,655,686 | A | | 8/1997 | Jermyn | |
| D390,744 | S | | 2/1998 | Otero | |
| 5,806,723 | A | | 9/1998 | DuBose | |
| D405,525 | S | | 2/1999 | Barrett et al. | |
| 5,897,872 | A | | 4/1999 | Picciano | |
| 5,899,878 | A | | 5/1999 | Glassman | |
| 5,967,377 | A | * | 10/1999 | Glynn | 222/158 |
| 6,006,952 | A | | 12/1999 | Lucas | |
| 6,035,769 | A | | 3/2000 | Nomura et al. | |
| D424,197 | S | | 5/2000 | Sydlowski et al. | |
| D426,300 | S | | 6/2000 | Conforti | |
| 6,135,358 | A | | 10/2000 | Ballini | |
| 6,238,377 | B1 | | 5/2001 | Liu | |
| 6,241,705 | B1 | | 6/2001 | Ko-Wen | |
| 6,293,436 | B2 | | 9/2001 | Faughnder et al. | |
| 6,520,384 | B2 | | 2/2003 | Mehta | |
| 6,540,718 | B1 | | 4/2003 | Wennek | |
| 6,558,344 | B2 | | 5/2003 | McKinnon et al. | |
| D481,794 | S | | 11/2003 | Krinsky | |
| 6,669,059 | B2 | * | 12/2003 | Mehta | 222/211 |
| D486,066 | S | | 2/2004 | Hannen et al. | |
| 6,688,497 | B2 | | 2/2004 | Mehta | |
| 6,736,792 | B1 | | 5/2004 | Liu | |
| D490,896 | S | | 6/2004 | Bogazzi | |
| D493,888 | S | | 8/2004 | Reschke | |
| D495,954 | S | | 9/2004 | Solomon | |
| D497,107 | S | | 10/2004 | Hama et al. | |
| 6,814,259 | B1 | | 11/2004 | Foster et al. | |
| 6,907,879 | B2 | | 6/2005 | Drinan et al. | |
| 6,976,669 | B2 | | 12/2005 | Van Zijll Langhout et al. | |
| D530,815 | S | | 10/2006 | Murphy et al. | |
| D538,474 | S | | 3/2007 | Sheppard et al. | |
| D548,334 | S | | 8/2007 | Izumi | |
| D550,097 | S | | 9/2007 | Lepoitevin | |
| 7,306,121 | B2 | | 12/2007 | Ophardt et al. | |
| D558,509 | S | | 1/2008 | Bodum | |
| D558,510 | S | | 1/2008 | Bodum | |
| D562,404 | S | | 2/2008 | Jansen et al. | |
| D584,151 | S | | 1/2009 | Murphy | |
| 7,500,584 | B2 | | 3/2009 | Schutz | |
| D590,493 | S | | 4/2009 | Harlan et al. | |
| D601,697 | S | | 10/2009 | Sobeich et al. | |
| D603,708 | S | | 11/2009 | Handy | |
| D608,645 | S | | 1/2010 | Handy et al. | |
| D612,736 | S | | 3/2010 | Pecora | |
| D613,601 | S | | 4/2010 | Yoneda | |
| 7,703,696 | B2 | | 4/2010 | Eddins et al. | |
| D627,458 | S | | 11/2010 | Bisson et al. | |
| D629,884 | S | | 12/2010 | Stephens | |
| D630,314 | S | | 1/2011 | Stephens | |
| 7,862,536 | B2 | | 1/2011 | Chen et al. | |
| D634,213 | S | | 3/2011 | Thompson | |
| D634,630 | S | | 3/2011 | Taylor | |
| D634,631 | S | | 3/2011 | Taylor | |
| 7,959,597 | B2 | | 6/2011 | Baker et al. | |
| 7,971,761 | B1 | | 7/2011 | Kudlu | |
| D653,953 | S | | 2/2012 | Wakeman | |
| 2002/0158089 | A1 | | 10/2002 | Mehta | |
| 2003/0062367 | A1 | | 4/2003 | Robinson et al. | |
| 2005/0049620 | A1 | * | 3/2005 | Chang | 606/162 |
| 2006/0008373 | A1 | | 1/2006 | Schutz | |
| 2006/0253087 | A1 | | 11/2006 | Vlodaver et al. | |
| 2008/0008979 | A1 | | 1/2008 | Thomas et al. | |
| 2008/0294124 | A1 | | 11/2008 | Mehta | |
| 2009/0234325 | A1 | | 9/2009 | Rozenberg et al. | |
| 2009/0281454 | A1 | | 11/2009 | Baker et al. | |
| 2010/0152653 | A1 | | 6/2010 | Hoke et al. | |
| 2011/0084099 | A1 | * | 4/2011 | Carta | 222/212 |
| 2011/0139149 | A1 | | 6/2011 | Cacka et al. | |
| 2011/0139824 | A1 | | 6/2011 | Cacka et al. | |
| 2011/0144588 | A1 | | 6/2011 | Taylor et al. | |
| 2011/0184341 | A1 | | 7/2011 | Baker et al. | |
| 2011/0319840 | A1 | | 12/2011 | Hair | |

FOREIGN PATENT DOCUMENTS

| | | |
|---|---|---|
| WO | WO9629044 | 9/1996 |
| WO | WO2005/000477 | 1/2005 |

OTHER PUBLICATIONS

Waterpik SinuSense, Website: http://www.insightsbyapril.com/2012/03/waterpik-natural-remedy-for-sinus.html, retrieved on May 31, 2012.

Author Unknown, "NasaFlo Neti Pot," http://www.neilmed.com/usa/nasaflo.php, 1 page, at least as early as Dec. 9, 2009.

Author Unknown, "SinuFlo Ready Rinse," http://www.neilmed.com/usa/sinuflo.php, 1 page, at least as early as Dec. 9, 2009.

Author Unknown, "Sinus Rinse Nasal Wash," http://www.neilmed.com/usa/sinusrinse.php, 3 pages, at least as early as Dec. 9, 2009.

Papsin et al., "Saline Nasal Irrigation," Canadian Family Physician, vol. 49, pp. 168-173, Feb. 2003.

Rabago et al., "Efficacy of Daily Hypertonic Saline Nasal Irrigation Among Patients with Sinusitus: A Randomized Controlled Trial," The Journal of Family Practice, vol. 51, No. 12, pp. 1049-1055, Dec. 2002.

Schumann et al., "Patients Insist on Antibiotics for Sinusitus? Here is a Good Reason to Say 'No'," The Journal of Family Practice, vol. 57, No. 7, pp. 464-468, Jul. 2008.

* cited by examiner

SQUEEZE BOTTLE FOR SINUS CAVITY RINSE

CROSS-REFERENCE TO RELATED APPLICATIONS

This application claims the benefit of priority under 35 U.S.C. §120 as a continuation-in-part of U.S. design application No. 29/352,093 entitled "Squeeze bottle for sinus cavity rinse" filed 16 Dec. 2009; as a continuation-in-part of U.S. design application No. 29/352,100 entitled "Nozzle" filed 16 Dec. 2009; as a continuation-in-part of U.S. design application No. 29/352,101 entitled "Nozzle and collar" filed 16 Dec. 2009; and as a continuation-in-part of U.S. design application No. 29/364,669 entitled "Faceted nasal seal with bottom rim" filed 25 Jun. 2010, the disclosures of which are hereby incorporated by reference in their entireties. This application claims the benefit of priority pursuant to 35 U.S.C. §119(e) of U.S. provisional application No. 61/287,016 entitled "Squeeze bottle for sinus cavity rinse" filed 16 Dec. 2009 and of U.S. provisional application No. 61/369,378 entitled "Faceted nasal seal" filed Jul. 30, 2010, the disclosures of which are hereby incorporated herein by reference in their entireties.

This application is related to the application entitled "Pot for Sinus Cavity Rinse" filed contemporaneously herewith and having Ser. No. 12/970,610; the application entitled "Bottle for Sinus Cavity Rinse" filed contemporaneously herewith having Ser. No. 12/970,788; the application entitled "Powered Irrigator for Sinus Cavity Rinse" filed contemporaneously herewith having Ser. No. 12/970,345; and the application entitled "Faceted Nasal Seal" filed contemporaneously herewith having Ser. No. 12/970,854, the disclosures of which are incorporated herein by reference in their entireties.

TECHNOLOGY FIELD

This disclosure relates to a squeeze bottle for a sinus rinse having a soft, self-sealing nozzle with air pressure-actuated firmness of the nozzle being affected by the bottle.

BACKGROUND

The benefits of rinsing one's sinus cavities have been well established, and include improving resistance to sinus infections, clogged sinuses, allergies, and general health. Oftentimes, however, the articles which one uses to rinse their nasal passages make the process unnecessarily difficult and uncomfortable. One of the issues is related to the inability to obtain an effective seal between the nozzle of one of these articles and the user's nasal passage. If the seal is not adequate, during use the fluid can leak from between the nozzle and the nasal passage, thereby making the rinsing process messy.

In addition, the control of the flow from the vessel into the sinus cavity has not been adequate in the past, and users have found it difficult to regulate the volume of flow so as to make the rinsing process comfortable. In one existing product, as shown in U.S. Patent App. No. 2008/0294124, an aperture is formed in the lid of the vessel which can be used to restrict the flow of the fluid in the vessel through the nozzle during the rinsing step. However, because the aperture is positioned in the lid, the user uses one hand to hold the vessel and another hand to control the flow by covering and uncovering the aperture. This proves to be a relatively difficult process when the user is already in an awkward position, such as being positioned over a sink during the rinsing process.

SUMMARY

In one implementation, a vessel for use in rinsing a user's nasal passage includes a main body, a nozzle, a check valve, and a collar connecting the nozzle and check valve to the main body. The check valve includes a first opening and a second opening, where the first opening provides fluid communication between the main body and a void formed in an interior of the nozzle, and the second opening provides fluid communication between an exterior of the main body and a fluid reservoir formed in the main body. The second opening cooperates with a valve that allows selective fluid communication between the exterior of the main body and the reservoir formed in the main body.

In another implementation, an article for rinsing a user's nasal cavity is disclosed. A main body defines a reservoir that receives a liquid and includes resiliently deformable walls and an upper opening defined by a rim. A nozzle includes an outer wall that forms a tip and defines an aperture, an inner wall that forms a fluid passageway in communication with said aperture and extends inside said outer wall, and a void space that is formed between the outer wall and the inner wall. A check valve housing is in fluid communication with a liquid delivery tube that extends into the reservoir. A collar is removably connectable with the upper opening of the main body and the collar couples the nozzle and the check valve to the upper opening of the main body when the collar is connected. A first opening formed through said check valve housing allows communication between the reservoir of said main body and the void space in the nozzle. The second opening is formed through the check valve housing and allows fluid communication between the exterior of said main body and the reservoir of said main body. A valve is associated with the second opening to allow fluid to flow from an area exterior to said main body into said reservoir.

In a further implementation, an article for rinsing a user's nasal cavity is disclosed. A main body defines a reservoir that receives a liquid and includes resiliently deformable walls and an upper opening defined by a rim. A nozzle includes an outer wall that forms a tip and defines an aperture, an inner wall forms a fluid passageway in communication with said aperture and extends inside said outer wall, and a void space is formed between the outer wall and the inner wall. A check valve housing is in fluid communication with a liquid delivery tube that extends into the reservoir. A first opening is formed through the check valve housing and allows communication between said reservoir of the main body and the void space in said nozzle. Deformation of the resiliently deformable walls of the main body causes fluid in the cavity to flow through the first opening and into said void space to increase the pressure in the void space.

The information included in this Background section of the specification, including any references cited herein and any description or discussion thereof, is included for technical reference purposes only and is not to be regarded subject matter by which the scope of invention is to be bound.

DETAILED DESCRIPTION

Figure 1:
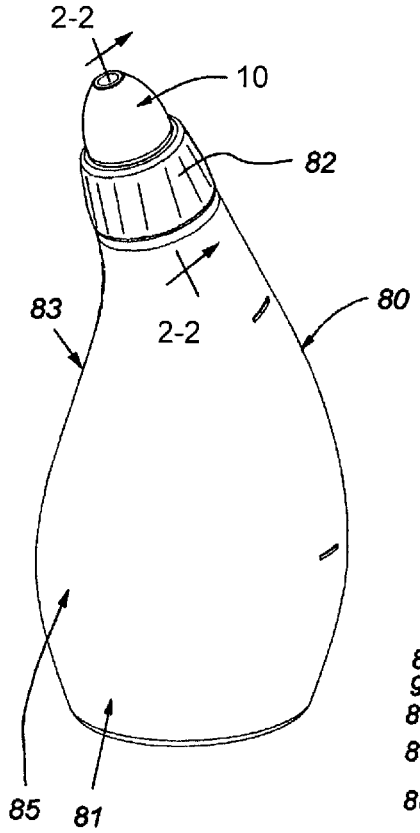
FIG. 1 is an isometric view of a squeeze bottle for sinus rinse including a main body, a soft, self-sealing nozzle having an aperture, and a collar attaching the nozzle to the main body.

FIG. 1 shows an implementation of a squeeze bottle 80 for a nasal cavity rinse. The squeeze bottle 80 includes a main body 85 made of low-density polyethylene (LDPE). The main body 85 defines a reservoir 87 in which a solution is placed for use in rinsing a user's nasal cavity. The top of the main body includes an opening upon which is secured a soft, self-sealing nozzle 10. The soft, self-sealing nozzle 10 is secured to the top opening of the main body 85 by a collar 82. The nozzle 10 includes an aperture 62 which allows the solution inside the main body reservoir to exit the squeeze bottle 80 as desired by the user. In the exemplary embodiment shown, the main body 85 has a bottom portion 81, which is relatively bulbous and fits well in a user's hand, and a top portion 83, which narrows down significantly from the bulbous portion of the bottom portion 81 to a generally circular dimension having an outer maximum dimension approximately the same as the maximum dimension of the circular collar 82 which attaches the sealing nozzle 10 to the top opening of the main body 85.

The sealing nozzle 10 is relatively dome-shaped with an aperture 62 positioned in the center of the top portion of the dome. The outlet aperture 62 of the nozzle 10 allows the solution inside the reservoir 87 of the main body 85 to exit the squeeze bottle 80 as desired by the user. The sidewalls of the sealing nozzle 10 extend down into the collar 82 to be secured by the collar 82 to the top opening of the main body 85. The outer diameter of the sealing nozzle 10 at the bottom edge may be significantly less than the outer diameter of the collar 82 holding the seal of the nozzle 10 to the main body 85.

The collar 82, securing the nozzle 10 to the main body 85, has a sloped outer surface angling from a smaller diameter to a larger diameter in the direction from top to bottom to form a frustum shape. An inner wall of the attachment collar 82 may define threads 89 for engagement with the squeeze bottle 80. A top portion of the collar 82 forms a top edge 72 for coupling with the nozzle 10. A bottom portion of the collar 82 may have a vertical sidewall. The collar 82 includes threads 89 formed on its interior surface for engaging with threads 88 of the main body 85.

Figure 2:
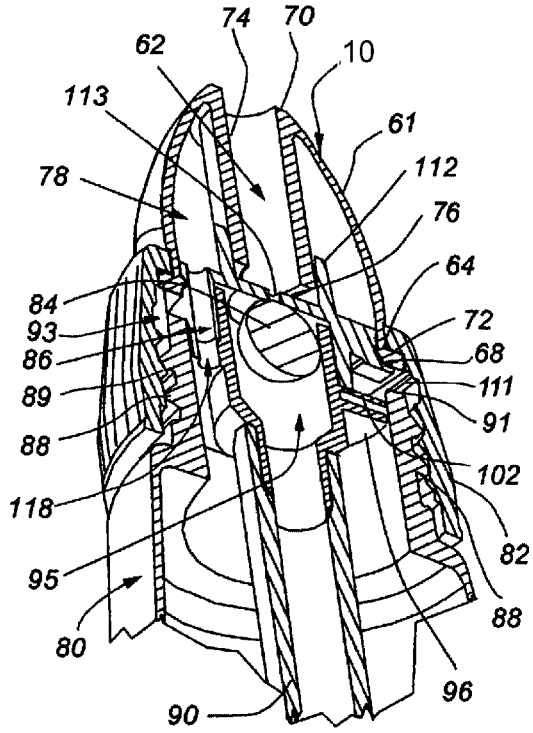
FIG. 2 is a cross-section view taken along line 2-2 of FIG. 1 showing the main body defining a reservoir, a nozzle attached to the top of the main body by a collar, a check valve positioned between the nozzle and the top of the main body, and a tube connected from the bottom of the check valve extending into the reservoir of the main body.

In FIG. 2, a section is shown through the squeeze bottle 80 of FIG. 1. In this figure, a check valve 86 is positioned between the nozzle 10 and the tube 90 extending into the reservoir 87 of the main body 85. The delivery tube 90 fluidly connects liquid within the reservoir 87 of the squeeze bottle 80 to the check valve 86. The check valve 86 allows fluid to be squeezed out of the main body 85. It opens when the main body 85 is squeezed to allow fluid to leave the aperture 62 of the nozzle 10 after traveling up the tube 90 from the bottom of the reservoir 87 formed in the main body 85. The check valve 86 closes once the main body 85 is no longer squeezed and is returning to its original shape.

The nozzle 10 is held to the top portion 83 of the main body by the collar 82. The lower rim 68 of the nozzle has a flange or rim formed thereon which is retained against the flange 111 of the check valve, which in turn is retained against the top rim 91 of the main body 85. Each of these is retained in position by the top edge 72 of the collar 82 which, once positioned over the nozzle 10 and the collar threads 89, is threadedly engaged with the threads 88 on the outer perimeter of the top portion 83 of the main body, clamps the lower rim 68 at the bottom of the nozzle and the check valve 86 to the top of the main body 85, and an airtight seal is formed between the nozzle 10, check valve 86, and top surface 91 of the main body. However, air can flow through the void 93 formed between the threads 88, 89 and into to the air inlet passage 110, as described below. Also, the threads 88, 89 may be removed along a portion of their length to create a "flat" spot to facilitate more direct and free airflow to the air inlet passage. In certain implementations, the nozzle may be faceted as illustrated in FIGS. 6, 7 and 10A-12 in which a faceted nozzle 60 is shown. It will be understood that common reference element numbers provided above and herein below denote common features shared between the nozzle 10 and the faceted nozzle 60.

Figure 6:
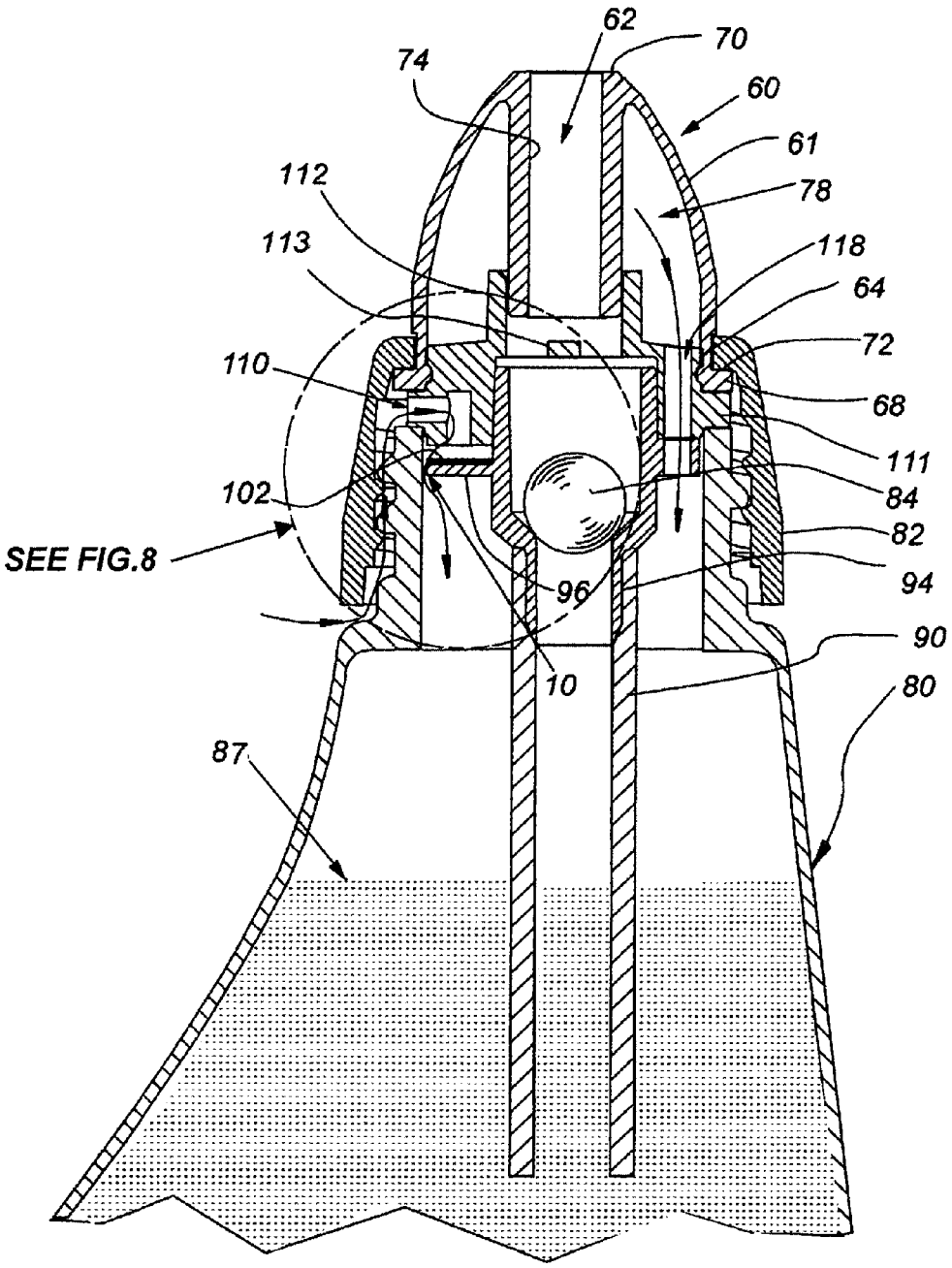
FIG. 6 is a cross-section view of the squeeze bottle depicted in FIG. 1 with a faceted nozzle, and shows the main body moving to an unsqueezed.

Accordingly, the nozzle 10 and the faceted nozzle 60 as shown in FIGS. 2 and 6, respectively, have an elliptical cross-section shape having a tube extension 74 extending downwardly from the aperture 62 at the tip 70 of the nozzle, the tube extension 74 having a cylindrical shape. The tube extension 74 may have a wall thickness of approximately 0.060 inches. A skirt wall 61 extends downwardly from the aperture 62 at the tip of the nozzle and forms the outer elliptical cross-sectional shape of the nozzle. The skirt wall 61 terminates in a lower rim 68 which extends radially outwardly from the skirt wall 61 and is part of the structure which is captured by the collar 82 as described above and again herein below.

An annular bead 63 is formed on the inner diameter of the lower end of the skirt wall 61 for receipt in an annular groove 114 formed on the outer periphery of the upper check valve housing 104. The skirt wall 61 may have a thickness of approximately 0.040 inches. The skirt wall 61 may be smoothly curved in the generally conical shape as shown, or may be faceted or otherwise made up of regions having flat extensions or mixed flat and curved extensions. Also, a rib may be formed around the skirt wall just above the bottom edge to provide a protrusion for enhancing a user's gripping force on the nozzle if necessary.

Figure 10A:
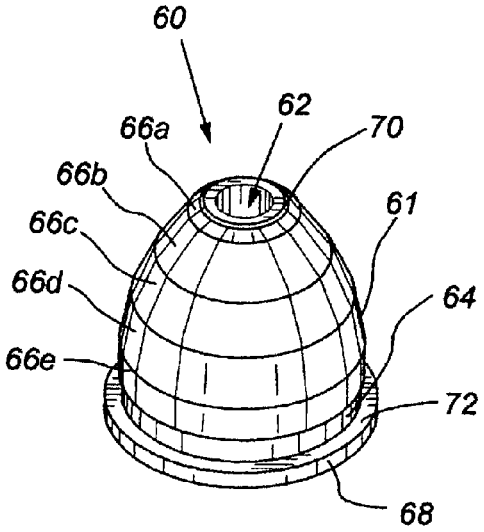
FIG. 10A an isometric view of an embodiment of a faceted nozzle.
Figure 10B:
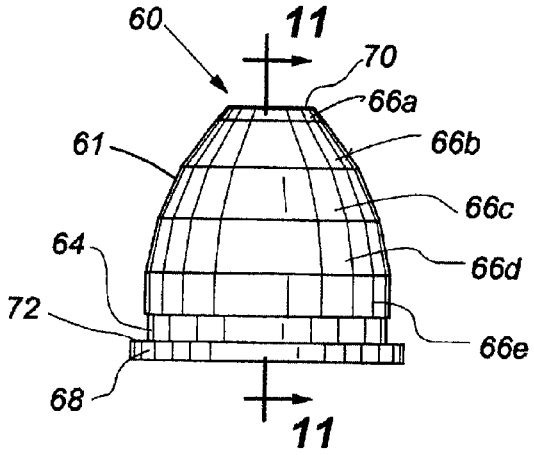
FIG. 10B is a side elevation view of the nozzle illustrated in FIG. 10A.
Figure 10C:
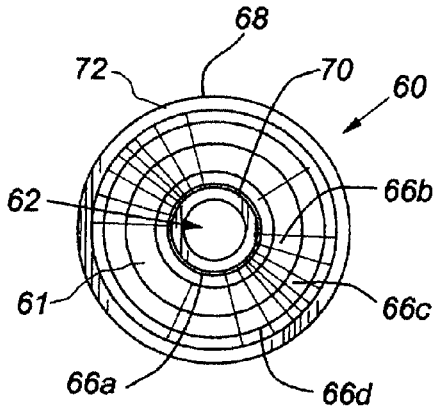
FIG. 10C is a top plan view of the nozzle illustrated in FIG. 10A.
Figure 10D:
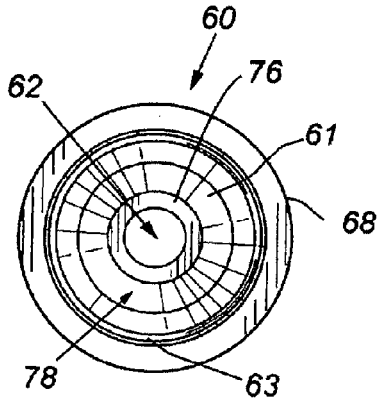
FIG. 10D is a bottom plan view of the nozzle illustrated in FIG. 10A.
Figure 10E:
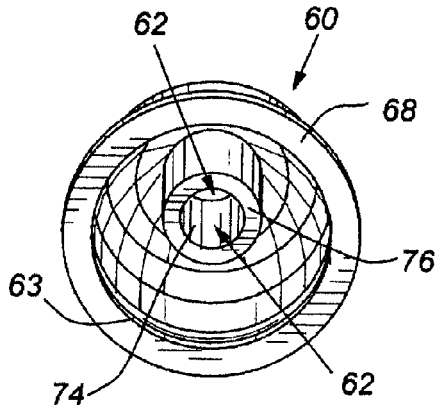
FIG. 10E is a bottom isometric view of the nozzle illustrated in FIG. 10A.
Figure 11:
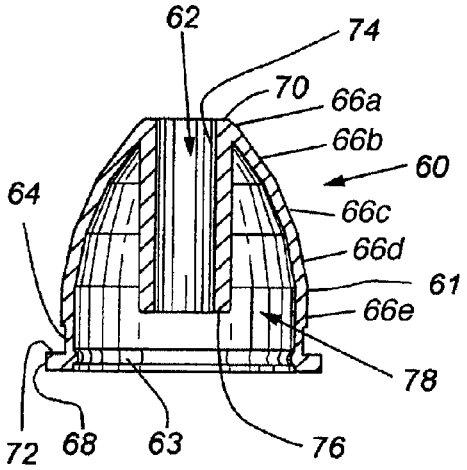
FIG. 11 is a cross-section view of the nozzle illustrated in FIG. 10A, viewed along line 11-11 in FIG. 10B.
Figure 12:
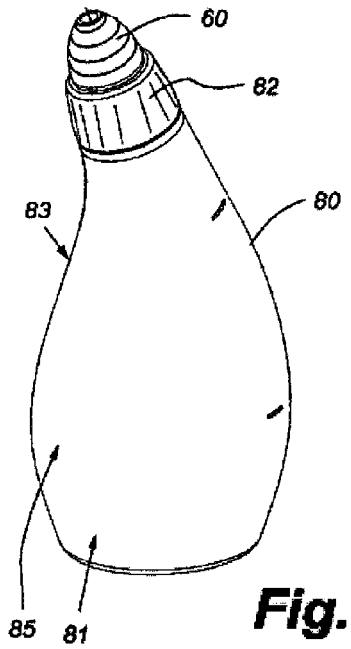
FIG. 12 is an isometric view of a squeeze bottle for sinus rinse with a faceted nozzle.

FIGS. 10A-10E illustrate the faceted nozzle 60 in detail. The faceted nozzle 60 may include a flange 68 at the terminal edge 24 of the skirt 61. Additionally, the skirt 61 in this embodiment defines at a recessed groove 64, which then expands outwards forming the flange 68. FIG. 10A illustrates an isometric view of the faceted nozzle 60, FIG. 10B illustrates a side elevation view of the faceted nozzle 60, FIG. 10C is a top plan view of the faceted nozzle 60, FIG. 10D is a bottom plan view of the faceted nozzle 60, and FIG. 10E is a bottom isometric view of the faceted nozzle 60. FIG. 11 is a section view of the faceted nozzle 60 of FIG. 10B taken along line 11-11. Referring to FIGS. 10A-11, the faceted nozzle 60 includes an outlet aperture 62 located at the apex of the tip 70. Extending outward and downward from the outlet aperture 62 is the skirt 61. The skirt 61 includes steps 66*a*-66*e* or facets along its outer surface. The steps 66*a*-66*e* also act to provide a seal against a nostril wall when the faceted nozzle 60 is inserted into a user's nasal cavity.

The skirt 61 of the faceted nozzle 60 acts to form a seal with the user's nostril when the faceted nozzle 60 is attached to the reservoir body 80. The skirt 61 includes steps 66*a*-66*e*, which create ridges the outer surface of the skirt 61. In some implementations, the steps 66*a*-66*e* may be approximately the same height; however each step 66*a*-66*e* may have a different average or center diameter. In these implementations, each step 66*a*-66*e* increases the overall outer diameter of the skirt 61 and the faceted nozzle 60 maintains a generally rounded shape. For example, the first step 66*a* has a smaller average diameter than the second step 66*b*, and so on. In other implementations the steps 66*a*-66*e* may have different widths, such that the first step 66*a* may cover a greater portion of the outer surface of the skirt 61 than the second step 66*b*.

For example, as can been seen in FIG. 10A, the steps 66*a*-66*e* may be a series of stacked conical frustums having different outer wall angles. Each step 66*a*-66*e* is sloped at a predetermined angled and the outer wall has a larger diameter at the bottom edge of the steps 66*a*-66*e* than at the top edge of each step 66*a*-66*e*. In these implementations, each step 66*a*-66*e* decreases in diameter from the bottom edge to the top edge. Additionally, each step 66*a*-66*e* may have a different average diameter than the preceding step 66*a*-66*e*. This is because each step 66*a*-66*e* may have a different outer wall angle than the previous step 66*a*-66*e*. In some embodiments, the configuration of stacked frustum sections on top of one another may include ridges between each of the steps 66*a*-66*e* at the point of transition, from one step 66*a*-66*e* to the next. This gives the skirt 61*a* faceted appearance and feel.

Figure 7:
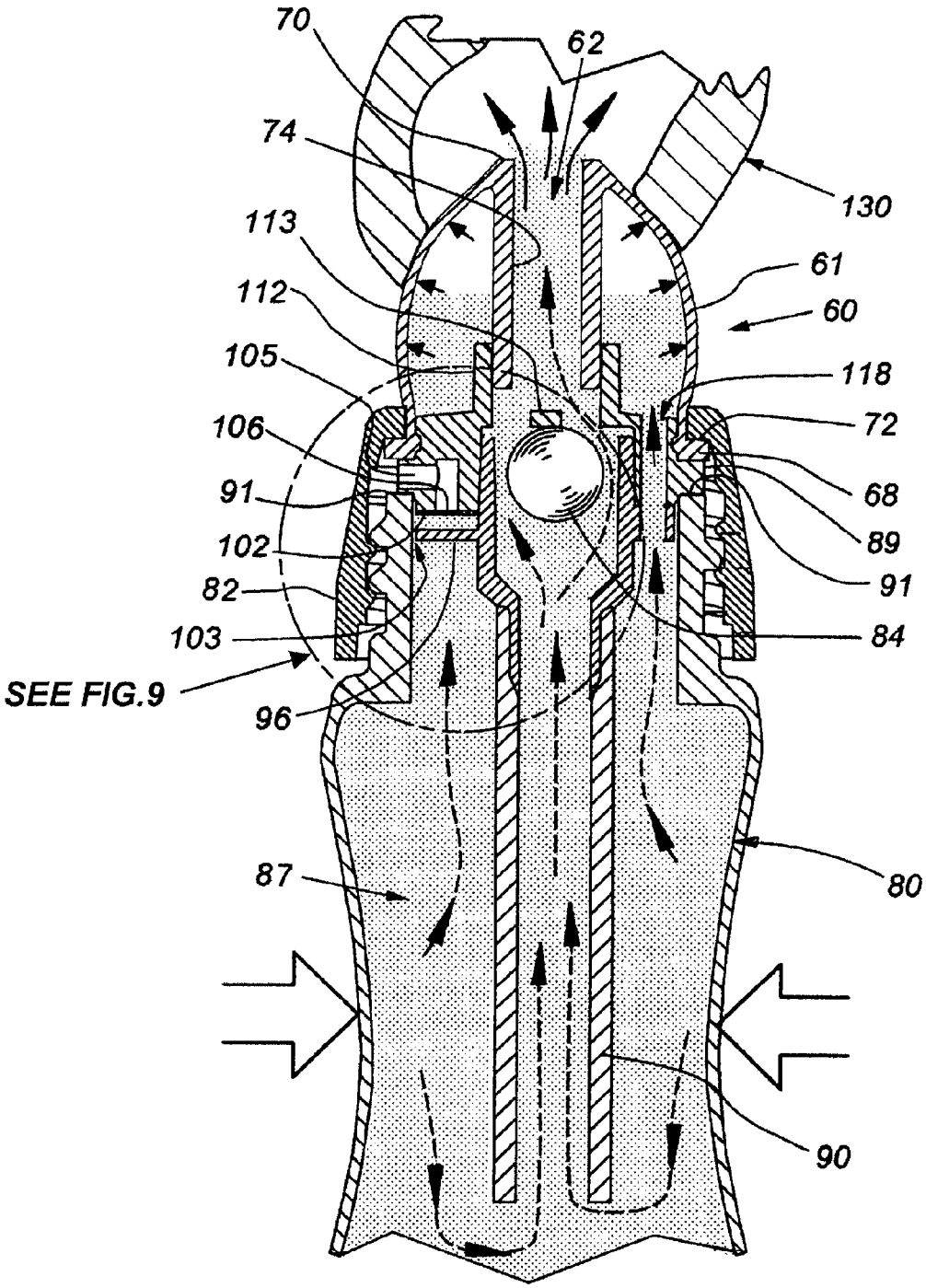
FIG. 7 is a cross-section view similar to that shown in FIG. 6, with the main body being squeezed to force liquid up the tube through the check valve and out the nozzle into the user's nasal cavity, as well as increasing the pressure and possibly the internal volume of the nozzle.
Figure 8:
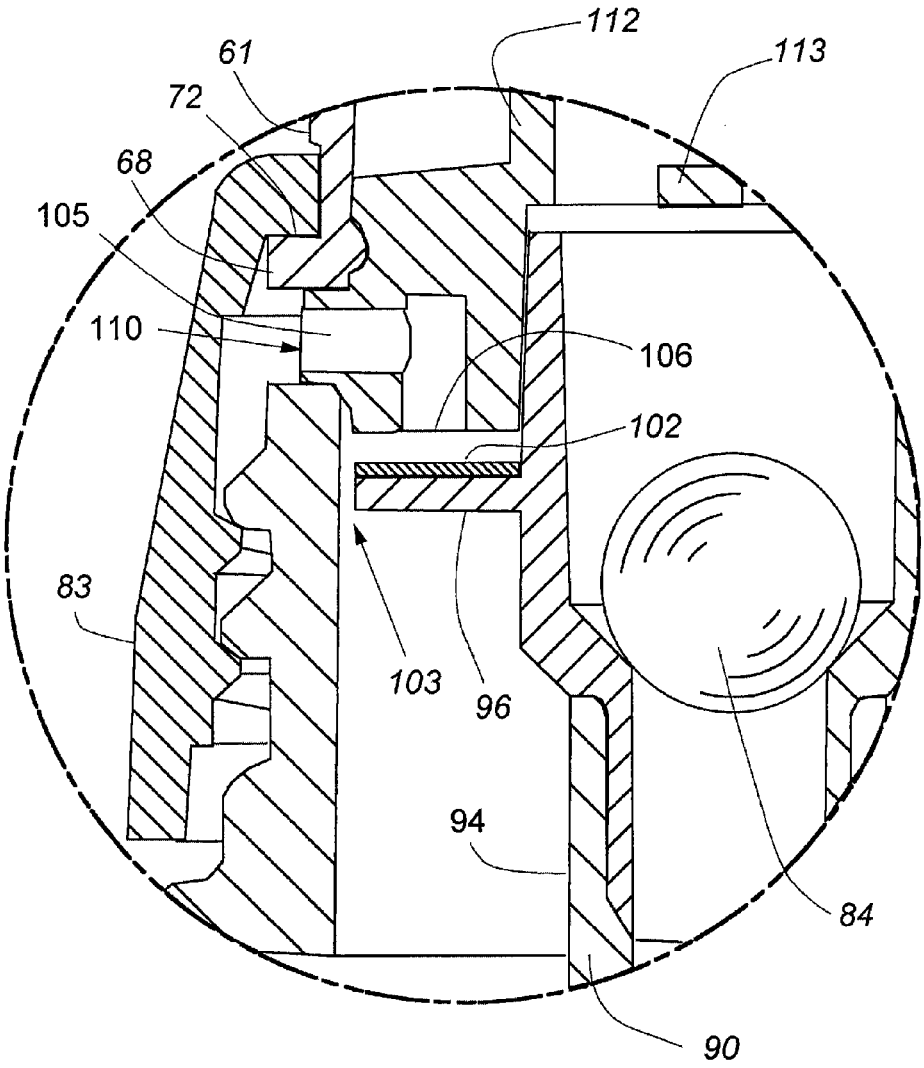
FIG. 8 is an enlarged cross-section view of FIG. 6 showing the reed valve in the opened position allowing air to pass into the main body through the air inlet passageway and the ball member in the valve seat preventing liquid or air from entering through the top of the check valve.
Figure 9:
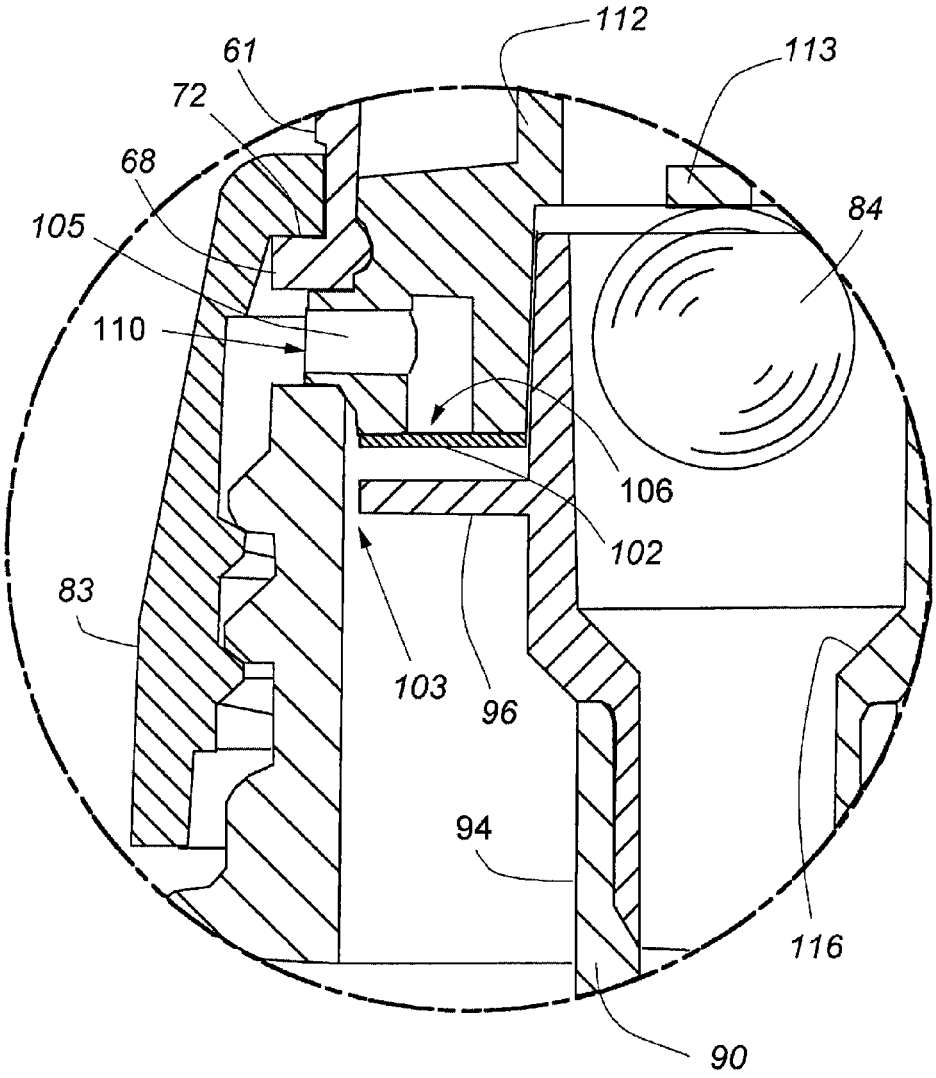
FIG. 9 is an enlarged cross-section view of FIG. 7 showing the reed valve in the closed position preventing air or liquid from passing through the air inlet passageway and the ball valve moved from the valve seat allowing liquid and air to pass from the reservoir of the main body through the check valve.

The tip 70 may be inserted into a user's nostril and one of the steps 66*a*-66*e* creates a seal between the faceted nozzle 60 and the nostril walls (see FIG. 7). The particular step 66*a*-66*e* that engages the user's nostril depends upon the size of the user's nostril. For example, the larger the user's nostril the lower the step 66*a*-66*e* may be that engages the nostril wall. The steps 66*a*-66*e* create a better seal than a purely rounded nozzle, as the steps 66*a*-66*e* better conform to the nostril wall—the nostril wall is not purely oval-shaped or conical-shaped—and the steps 66*a*-66*e* better mimic the inner surface of the nostril wall. It should be noted that although five steps 66*a*-66*e* have been illustrated, any number of steps 66*a*-66*e* may be included. The number of steps 66*a*-66*e* may be altered to create a smoother or rougher skirt 61. For example, depending on the desired sealing level the number of steps 66*a*-66*e* may be increased or decreased.

The skirt 61 illustrated in FIGS. 10A-11 terminates at the recessed groove 64, which has a smaller diameter than the fifth step 66*e*, such that the diameter of the faceted nozzle 60 decreases after the fifth step 66*e*. The recessed groove 64 then expands into the flange 68, which has a larger diameter than the fifth step 66*e*. In this implementation, the groove 64 reduces the diameter of the faceted nozzle 60 at the end of the skirt 61. The groove 64 may be used to better attach the faceted nozzle 60 to a nasal rinse reservoir by providing a connection location, for example, for the collar 82 described below. In other embodiments the groove 64 may be used to reduce the material used to create the faceted nozzle 60. As can been seen from FIG. 10C, the flange 68 may form the largest diameter of the faceted nozzle 60 and may be larger than any of the steps 66*a*-66*e*. The recessed groove 64 and the flange 68 may be used to secure the faceted nozzle 60 to a nasal rinse squeeze bottle, which will be discussed in more detail below with respect to FIGS. 2 and 6.

Referring now to FIGS. 10A-11, the faceted nozzle 60 includes an inner collar 74 or conduit extending downwards from the tip 70, creating the outlet aperture 62. The inner collar 74 may extend to the tip 70 and be substantially the same diameter throughout its entire length. The inner collar 74 extends downward and is surrounded by the skirt 61. The distal end 76 of the inner collar 74 terminates before extending as far as the outer groove 64 or the flange 68. However, in other embodiments the inner collar 74 may extend the entire length of the faceted nozzle 60. In some implementations, the inner collar 74 may have a wall thickness of approximately 0.060 inches.

As can be seen in FIGS. 10A-11, the inner wall 79 of the skirt 61 surrounds the inner collar 74 and the inner collar 74 is separated from the inner wall 79, such that the inner collar 74 and the inner wall 79 may not contact each other. In this implementation, the space between the inner collar 74 and the inner wall 79 of the skirt 61 creates a void 78 or empty area when the nozzle is connected to the squeeze bottle reservoir.

FIGS. 2 and 6 illustrate the faceted nozzle 60 attached to a nasal rinse squeeze bottle 80 by an attachment collar 82. The attachment collar 82 extends over a portion of the faceted nozzle 60, to better secure the faceted nozzle 60 to the squeeze bottle 80. The outer diameter of the faceted nozzle 60 at the flange 68 may be less than the outer diameter of the attachment collar 82 holding the faceted nozzle 60 to the squeeze bottle 80. A top shelf or shoulder 87 of the attachment collar 82 sits on top of the flange 68 and rests on the upper surface 72 of the flange 68. Additionally, the shoulder 87 extends at least partially into the recessed groove 64 on the faceted nozzle 60. The attachment collar 82 helps anchor the faceted nozzle 60 as well as create an airtight seal when the faceted nozzle 60 is held in place against the squeeze bottle 80.

Additionally the flange 68 is retained against a collar of a check valve 86 (further described below), which in turn is retained against a top rim 91 of the main body 85 of the squeeze bottle 80. Each of these is retained in position by the shoulder 87 of the attachment collar 82, which once positioned over the faceted nozzle 60 and threadedly engaged with the threads 88 on the outer perimeter of the top portion 83 of the main body 85, clamps the flange 68 of the faceted nozzle 60 and the check valve 86 to the top of the squeeze bottle 80.

The faceted nozzle 60 is also attached to the check valve 86 by the inner collar 74. The valve assembly 86 includes an upwardly extending rim 112 that connects with the inner collar 74, fluidly connecting the inside of the squeeze bottle 80 with the outlet aperture 62 of the faceted nozzle 60. In this implementation the inner collar 74 may be received partially within the extending rim 112. However, in other embodiments, the extending rim 112 may be received within the inner collar 74. Additionally, an o-ring or other sealing mechanism may be inserted within the rim 112 to fit around the inner collar 74 in order to better seal the connection between the extending rim 112 and the inner collar 74.

As can be seen in FIG. 6, an annular rim 112 of the check valve forms a recess above the flange 111, and the annular recess receives the tube extension 74 of the nozzle to help anchor the faceted nozzle 60 as well as create an airtight seal when the faceted nozzle 60 is held in place against the check valve 86 and the top rim 91 of the main body by the collar 82. The annular bead 63 or rim at a bottom portion of the skirt wall 61 is received in the annular groove 114 formed in the outer perimeter of the upper check valve 104 as described above. A flange or lower rim 68 extends radially outwardly from the base of the skirt wall 61 on the nozzle and is the bearing surface against which the collar 82 engages to clamp the rim 68 with the flange 111 on the upper check valve housing 92 against the top rim 91 of the main body 80 to create an airtight seal between the faceted nozzle 60, check valve 86, and top surface 91 of the main body.

Figure 3:
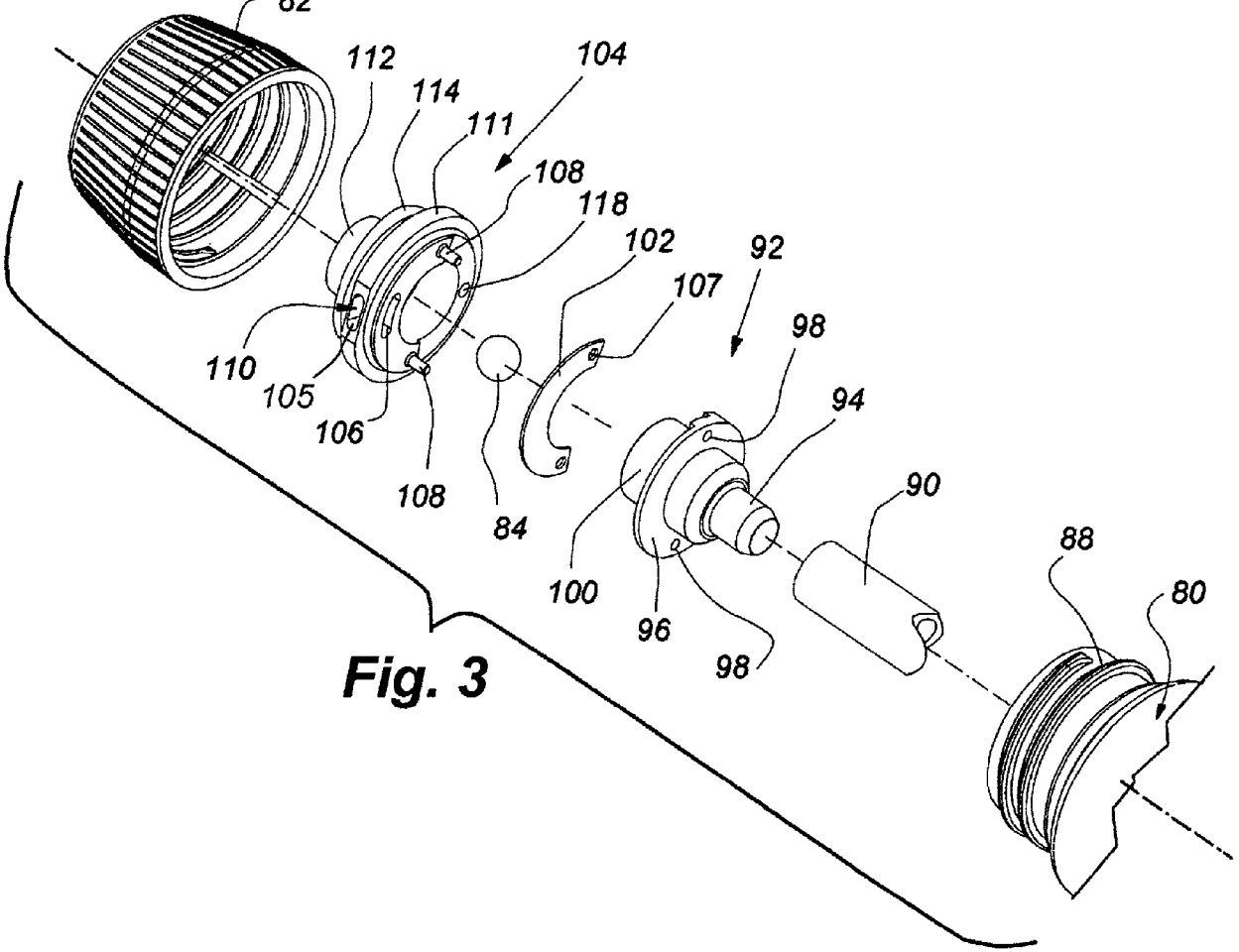
FIG. 3 is an exploded view of the check valve with the collar and main body shown in FIG. 2.
Figure 4A:
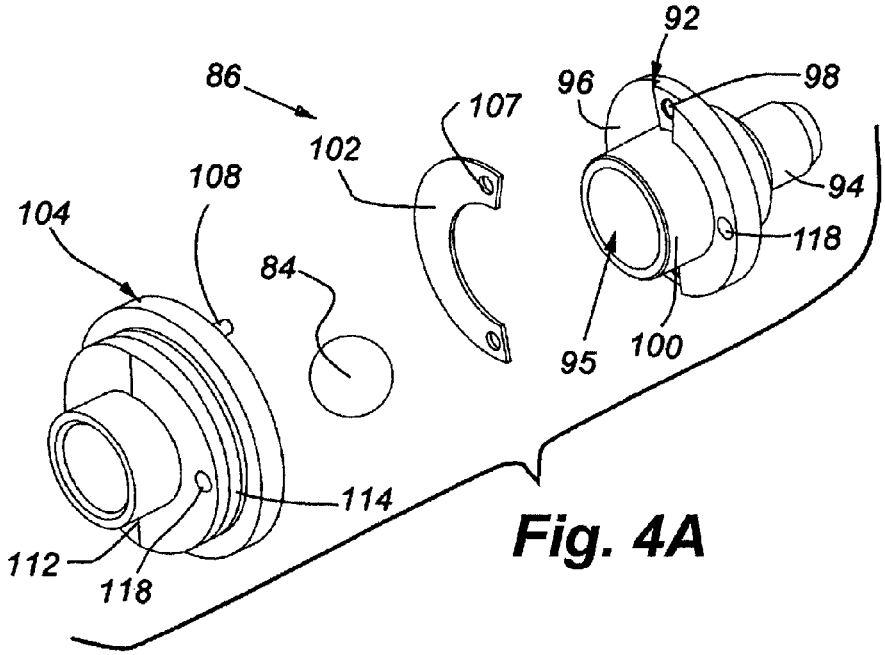
FIGS. 4A and 4B are exploded, top and bottom isometric views of the check valve similar to FIG. 3.
Figure 4B:
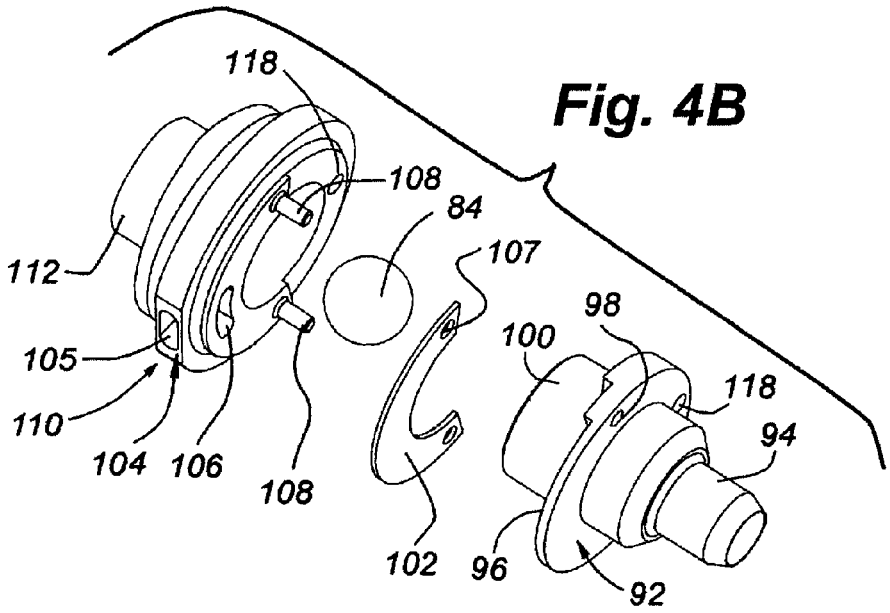
Figure 5B:
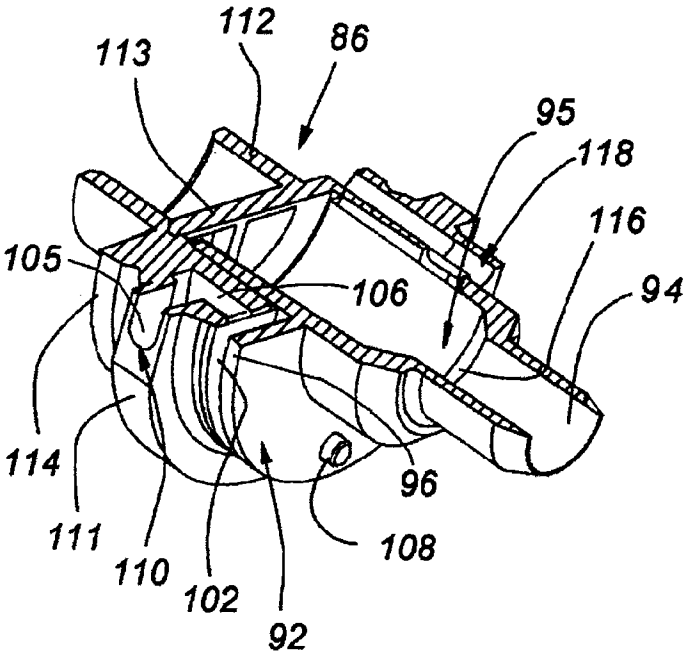
FIG. 5B is a cross-section view of the check valve in FIG. 5A as indicated by line 5B-5B in FIG. 5A.
Figure 5A:
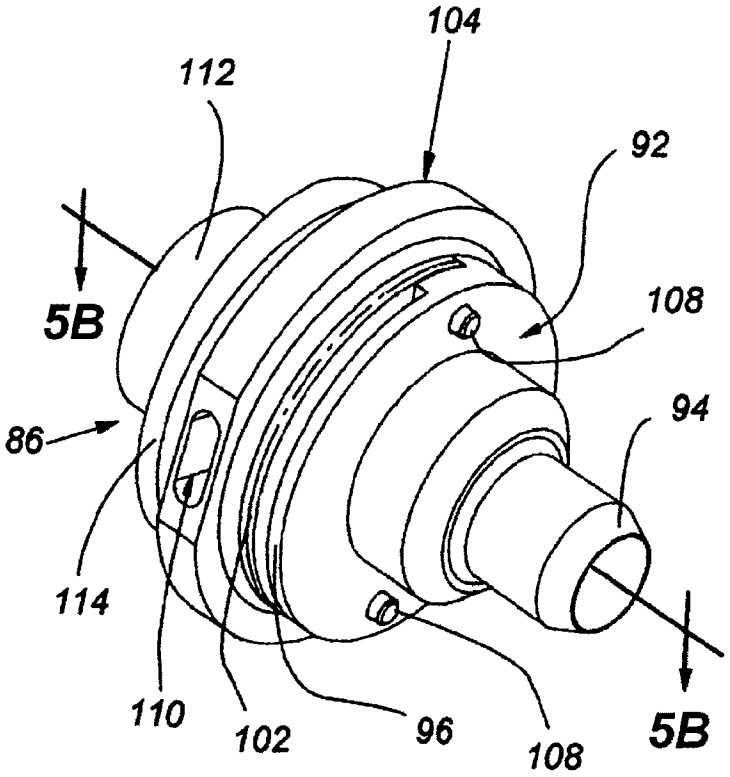
FIG. 5A is an isometric, isolated view of the check valve, with the check valve including an upper portion and a lower portion, and together forming the air pressure channel, as well as the air inlet channel.

FIG. 2 illustrates a cross-section view of the nozzle secured to the squeeze bottle 80 and FIG. 3 illustrates an exploded view of the attachment collar 82 and the check valve 86. FIG. 4A is an enlarged, left-side, exploded isometric view of the valve housing illustrated in FIG. 3. FIG. 4B is an enlarged, right-side, exploded isometric view of the valve housing illustrated in FIG. 3. FIG. 5A is an isometric view of the valve housing removed from the squeeze bottle. FIG. 5B is a cross-section view of the valve housing viewed along line 5B-5B in FIG. 5A. Referring to FIGS. 2 and 6, the check valve 86 is positioned in fluid communication between the outlet aperture 62 in the faceted nozzle 60 and a delivery tube 90 extending from the bottom of the check valve 86 into the reservoir formed in the squeeze bottle 80. The check valve 86 has an upper portion 104 and a lower portion 92, as shown in FIG. 5B, and defines a contained space forming a cavity 95.

Referring to FIGS. 3-4B, the upper portion 104 and the lower portion 92 of the check valve 86 may be secured together via attachment pegs 108 extending from a bottom surface of the upper portion 104. The attachment pegs 108 are received within receiving apertures 98 on the lower portion 92 of the housing. The attachment pegs 108 may also attach to a reed valve 102 through securing apertures 107 disposed on the reed valve 102 at the terminal ends of the semi-circular shaped reed valve 102. In this implementation, the upper housing 104, the reed valve 102, and the lower housing 92 are secured together to form the check valve 86 as illustrated in FIG. 5A.

An annular extension 94 extends from the bottom of the lower check valve housing 92 for receiving the top end of the liquid delivery tube 90 in a friction-fit engagement. The end of the annular extension 94 may be chamfered to help guide the liquid delivery tube 90 onto the annular extension 94.

The lower check valve housing 92 includes a circular conical wall 100 protruding from a top end that is received in a recess formed by the upper check valve housing 104 when the housing portions are positioned together. The ball member 84 is received within the cavity 95 defined within an interior the assembled check valve 86. At the bottom of the lower check valve housing 92, the delivery tube 90 is attached to an annular extension 94 depending from the lower check valve housing 92.

Referring to FIGS. 3, 4A, and 5B, a cavity 95 is formed within the lower portion 92, and a valve seat 116 is formed near the bottom of the cavity 95 by a circular conical wall 100, and a retention structure 113 is formed at the top which allows fluid through but does not allow the ball member 84 through. In operation, with fluid pressure from below when the main body 85 is being squeezed, the fluid pushes the ball member 84 out of the valve seat 116 and up against the retention structure 113, with the liquid flowing around the retaining structure 113 and out the aperture of the nozzle 62. When the main body 85 is not being squeezed, it is resilient and returns to its original shape which relieves the pressure of the fluid on the ball member 84, which allows the ball member 84 to move back down into the valve seat 116 and keep any liquid from flowing back into the reservoir 87 in the main body 85. This is beneficial to keep any fluid that may come back into the tip from the user's nostrils or sinus' from getting back into the liquid positioned in the main body 85.

The ball 84 may move freely within the cavity 95. However, the retention structure 113 is at the top of the cavity 95. The retention structure 113, which may be in the shape of a cross extending across the fluid passageway formed through the center of the check valve 86, prevents the ball 84 from moving out of the cavity 95 into the upper portion 104 of the check valve 86. The cavity 95 and the retention structure 113 are in fluid communication with the inner collar 74 above and the liquid delivery tube 90 extending below into the squeeze bottle 80. That is, the recess 95 acts as a fluid conduit, connecting the delivery tube 90 and the extending rim 112. The sidewalls of the recess 95 are generally cylindrical, and taper at their bottom ends to form a valve seat 116. When the ball 84 is on the valve seat 116, the fluid in the cavity 95 above the ball 84 is largely restricted from flowing back down into the liquid delivery tube 90, and thus may not go back into the squeeze bottle 80. In this way, any liquid coming back into the faceted nozzle 60 is unlikely to contaminate the liquid in the squeeze bottle 80.

The upper check valve housing 104 defines a vertical rim 112 protruding from its top end, which receives a tubular extension 74 depending from the aperture 62 formed at the tip 70 of the faceted nozzle 60. The inner diameter of the vertical rim 112 and the outer diameter of the tubular extension 74 may have substantially similar dimensions to provide a sealing fit or a friction fit engagement. The extending rim 112 is fluidly connected to the outlet aperture 62 when the faceted nozzle 60 is connected to the squeeze bottle 80. The cavity 95 acts as a fluid conduit, connecting the delivery tube 90 and the extending rim 112. Additionally, the sidewalls of the cavity 95 are generally cylindrical, and taper at their bottom ends to form the valve seat 116.

As shown in FIG. 5B, the check valve 86 also defines a passageway 118 creating communication for air or liquid from the reservoir 87 of the squeeze bottle 80 through the passageway 118 and into the void space 78 between the faceted nozzle 60 and the check valve 86. The air pressure passageway 118 is formed to extend through the lower check valve housing 92 and the upper check valve housing 104, and a lower opening into the squeeze bottle 80 and an upper opening into the void space 78. The air pressure passageway 118 allows fluid and/or gaseous communication between the reservoir 87 of the main body 85 and the void space 78 formed between the tube extension 74 and the skirt wall 61 in the faceted nozzle 60. The void space 78 may be annular around the tube extension 74, or may not be continuous.

Additionally, an air inlet passageway 110 and a reed valve structure 102 is also formed in the check valve 86 which allows air to be drawn into the reservoir 87 in the main body 85 when the main body is not being squeezed and is returning from a squeezed to an unsqueezed configuration, and thus draws air in through the air inlet passageway 110. The air inlet passageway 110 is provided in a discrete location of the check valve 86 housing in relation to the air pressure passageway 118. For example, as depicted in FIGS. 3-5B, the air inlet passageway 110 and the air pressure passageway 118 are arranged at opposite ends of the annularly shaped check valve 86, e.g., the two are separated by approximately 180°. In addition, while the air pressure passageway 118 provides open fluid communication between the void space 78 of the faceted nozzle 60 and the reservoir 87 of the main body 85, the reed valve structure 102 resiliently seals the air inlet passageway 110, as described below.

In FIG. 3, the air inlet passageway 110 is shown extending from an outer portion of the upper check valve housing 104. In one exemplary embodiment, the outer opening 105 of the air inlet passageway 110 may have an area of approximately 0.01 inches squared, is generally oval in shape and extends radially or laterally into the upper check valve housing 104. However, it may be differently shaped as desired. The inflation port 106 of the air inlet passageway 110 extends axially in the upper check valve housing 104 and forms a continuous passage with the radially extending outer opening 105. The check valve housing has an outwardly extending flange 111 around about its middle which is the portion of the check valve housing that is trapped by the collar 82 against the top rim 91 of the main body. As shown in FIGS. 5A, 5B, and 6, the inflation port 110 is formed in the check valve 86 that communicates between the reservoir 87 of the squeeze bottle 80 and the atmosphere. The threading 89 of the attachment collar 82 and the threading 88 of the squeeze bottle 80 are designed to create a void 93 to allow an air gap between adjacent threads. Thus, air can travel in a spiral path between the threads 88, 89 to enter the inflation port 110 and fill the reservoir in the squeeze bottle 80 after fluid has been dispensed, thus preventing the check valve 86 from creating a vacuum.

The valve on the air inlet passageway 110 may be a reed valve 102, such as a flapper valve, and when the main body 85 is being squeezed to force fluid out of the nozzle, the flapper valve covers the inflation port 106 of the air inlet passageway 110 and thus blocks the flow of air out of the air inlet passageway 110, which helps force the fluid up the delivery tube 90. This is described in greater detail below. The reed valve 102 is shown in FIG. 5A as extending in a semi-circular orientation inside of a slot formed below the flange 111 extending from the check valve 86. The lower bounds of the semi-circular slot are formed by the guard 96 mentioned above with respect to FIGS. 2 and 6. The reed valve 102 is a thin, flexible piece of FDA grade silicone rubber having a thickness of approximately 0.015 inches thick. Again, the guard 96 helps keep the reed valve 102 from opening too far as well as protects the reed valve 102 from interference by any particulates that may find their way into the liquid received in the reservoir 87 of the main body.

Referring to FIGS. 5A through 9, the reed valve 102 is disposed between the upper portion 104 and lower portion 92 of the check valve 86. The reed valve 102 covers the air inlet port 110 to selectively connect the inflation port 106 to the reservoir 87 of the squeeze bottle 80. The inflation port 106 is the internal opening of the air inlet port 110. The reed valve 102 may be a flat flexible semi-circular plate structure which is attached on the pegs 108 between the upper portion 104 and the lower portion 92 at its ends in a cantilever fashion. This reed valve 102 is typically in a closed position in which it seals against the inflation port 106 and opens under the negative pressure of the squeeze bottle 80 when moving from a squeezed to the un-squeezed position. The reed valve 102 material may be FDA grade silicone rubber and may be approximately 0.015 inches thick.

A guard plate 96 extends radially outwardly from the outer surface of the lower portion 92 of the check valve 86 in order to protect the reed valve 102 from interference by particulates and also to keep the reed valve 102 from opening too far. In FIG. 6, a gap 10 is formed between the end of the guard 96 and the inner wall of the top portion of the main body 85 to allow air or liquid to flow thereby towards the reed valve 102 and the inflation port 106 of the air inlet passageway 110. When the reed valve 102 is open, the gap 10 allows air to flow from the void space 93 in the threaded interconnection into the air inlet passageway 110, past the reed valve 102 and through the gap 10 into the reservoir 87 of the main body 85.

Referring to FIGS. 6 through 9, in operation, when the faceted nozzle 60 is inserted into the user's nostril opening, the skirt 61 may deform based on contact with the edges of the nostril. With fluid pressure from below when the main body 85 is squeezed, the fluid travels via the delivery tube 90 and pushes the ball 84 out of the valve seat 116 up against the retention structure 113. Liquid then flows around the ball 84 and the retention structure 113 and out the outlet aperture 62 of the faceted nozzle 60. The liquid cannot escape through the inflation port 106 because the reed valve 102 is closed.

When the main body 85 is squeezed (FIG. 7 and FIG. 9), the passageway 118 formed through the check valve 86 allows air or liquid pressure to be applied to the skirt 61 walls inside the void space 78 in the faceted nozzle 60, thus creating an outward pressure on the skirt walls 61 of the faceted nozzle 60 and enhancing the fit of the faceted nozzle 60 within the nostril of the user. Whether it is liquid or air flowing into the void space 78 in the nozzle, that liquid or air pressure helps create a firm but forming fit of the faceted nozzle 60 against the user's nostril during the nasal cavity process. Pressure in the void space 78 also causes the skirt 61 and/or the tubular extension 74 to force liquid out of the nozzle aperture 62.

When the main body 85 is no longer being squeezed, the resilient sidewalls are biased back into their original position, which creates a vacuum or negative pressure inside the cavity 95, allowing the ball 84 to move back down into the valve seat 116 and prevents fluid from flowing back into the reservoir 87. This is beneficial as it prevents fluid that may come back into the outlet aperture 62 from the user's nostrils or sinus from draining into the reservoir in the squeeze bottle 80.

Furthermore, the air inlet passageway 110 in combination with the reed valve 102 substantially prevent a vacuum from occurring within the squeeze bottle 80 after squeezing. That is, after squeezing, the squeeze bottle 80 reservoir 87 may be under negative pressure or vacuum pressure, and the reed valve 102 opens based on this pressure. When the reed valve 102 opens, the air inlet passageway 110 connects to the reservoir 87, as the inflation port 106 becomes unblocked, allowing air to enter. The air flowing into the air inlet passageway 110 comes through the void space 93 in the thread structure 88, into the outer opening 105 of the inlet passageway 110, through the inflation port 106 of the air inlet passageway 110, and past the reed valve 102 and the gap 10 formed between the end of the guard 96 and the inner wall of the top portion of the main body 85. The air then flows down into the reservoir 87 in the main body 85 until the main body 85 is back to its original configuration.

After the squeeze bottle 80 has returned to its original shape and pressure within the reservoir 87 has been equalized, the reed valve 102 resiliently moves to its closed position and closes over the inflation port 106 of the air inlet passageway 110 and the bottle 80 is ready for the next application. This helps to prevent the squeeze bottle 80 from remaining in a compressed shape after the user has stopped squeezing the bottle 80.

The compression of the main body 85 to force liquid out of the reservoir 87 therein is shown in FIG. 7 and the extension of the main body 85 from the squeezed configuration to the unsqueezed configuration with the associated liquid and air flows are shown in FIG. 6.

The two valves, the reed valve 102 and the check valve 86, operate together to provide improved protection against the drawing of the nasal wash from back-flowing into the bottle 80. The check valve 86 moves to the closed position (under vacuum pressure) when the squeeze bottle 80 is moving to the uncompressed configuration. This provides a physical block to the passage of any used nasal wash flowing back into the delivery tube 90 and into the bottle 80. In addition, however, the reed valve 102 acts as a vacuum breaker to allow air into the bottle 80 through a different passage than the check valve 86, which reduces the vacuum pressure caused by the expansion of the bottle 80 sidewalls that tries to draw fluid in through the check valve 86.

While the methods disclosed herein have been described and shown with reference to particular steps performed in a particular order, it will be understood that these steps may be combined, subdivided, or re-ordered to form an equivalent method without departing from the teachings of the as claimed below. Accordingly, unless specifically indicated herein, the order and grouping of the steps are not generally intended to be a limitation of the present invention.

A variety of embodiments and variations of structures and methods are disclosed herein. Where appropriate, common reference numbers were used for common structural and method features. However, unique reference numbers were sometimes used for similar or the same structural or method elements for descriptive purposes. As such, the use of common or different reference numbers for similar or the same structural or method elements is not intended to imply a similarity or difference beyond that described herein.

The references herein to "up" or "top", "bottom" or "down", "lateral" or "side", and "horizontal" and "vertical", as well as any other relative position descriptor are given by way of example for the particular embodiment described and not as a requirement or limitation of the squeeze bottle 80 or the apparatus and method for assembling the squeeze bottle 80. Reference herein to "is", "are", "should", "would", or other words implying a directive or positive requirement are intended to be inclusive of the permissive use, such as "may", "might", "could" unless specifically indicated otherwise.

The above specification, examples and data provide a complete description of the structure and use of exemplary embodiments of the invention as defined in the claims. Although various embodiments of the claimed invention have been described above with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. An article for rinsing a user's nasal cavity comprising a main body defining a reservoir for receiving a liquid, the main body having resiliently deformable walls, the main body having an upper opening defined by a rim;

a nozzle having an outer wall forming a tip and defining an aperture formed therein and further extending radially outward and downward to form a skirt ending at a terminal edge, an inner wall forming a fluid passageway in communication with the aperture and extending inside the outer wall, a nozzle void space being formed between the outer wall and the inner wall;

a check valve in fluid communication with the nozzle and enclosed within a valve housing, wherein the valve housing further defines a first opening, a second opening, and a valve associated with the second opening;

a liquid delivery tube extending from the check valve into the reservoir that provides fluid communication between the reservoir and the check valve; and an annular collar having a top edge, a bottom edge, and a plurality of collar threads extending between the to edge and the bottom edge, wherein the collar threads are threadingly engaged with corresponding body threads on the main body; wherein the annular collar couples the nozzle and the check valve to the upper opening of the main body;

a collar void space is defined between the body threads on the main body and the collar threads on the annular collar when the annular collar is connected with the rim;

the skirt of the nozzle above the terminal edge extends beyond the top edge of the annular collar;

the first opening formed through the valve housing allows fluid communication between the reservoir of the main body and the void space in the nozzle;

the second opening formed through the valve housing allows fluid communication between an exterior of the main body and the reservoir of the main body;

the valve associated with the second opening allows fluid to flow from an area exterior to the main body into the reservoir; and the collar void space is in selective fluid communication with the second opening to define a fluid path between the exterior of the main body and the reservoir.

2. The article of claim 1, wherein the outer wall of the nozzle is faceted in a form that comprises a plurality of stacked conical frustums of differing outer wall angles.

3. The article of claim 1, wherein deformation of the resiliently deformable walls of the main body causes fluid in the cavity to flow through the first opening and into the nozzle void space to increase the pressure in the nozzle void space; and reformation of the resiliently deformable walls of the main body after deformation causes the fluid in the nozzle void space to return to the cavity in the main body, and allows fluid from the cavity void space to flow from the exterior, through the valve into the cavity.

4. The article of claim 3, wherein as the main body is reformed, the valve allows fluid to flow from an area exterior to the main body through the second opening and into the reservoir.

5. The article of claim 3, wherein the check valve housing is directly connected to the nozzle and defines a fluid passageway having an upper opening and a lower opening;

the upper opening is in fluid communication with a bottom edge of the inner wall of the nozzle, a ball member is seated within the fluid passageway; and the lower opening is in fluid communication with the liquid delivery tube.

6. The article of claim 5, wherein deformation of the resiliently deformable walls of the main body causes fluid in the cavity to flow through the liquid delivery tube and the fluid pushes the ball member out of a seated position and up against a retention structure, thereby allowing fluid to flow out the aperture of the nozzle.

7. The article of claim 6, wherein when the main body is not being deformed, a pressure of the fluid on the ball member is relieved and allows the ball member to move back down into the seated position thereby preventing fluids from flowing from the upper opening into the lower opening.

8. The article of claim 5, wherein the annular collar connects with the upper opening of the main body and causes a bottom edge of the outer wall of the nozzle and the check valve housing to form a seal with the rim of the upper opening.

9. The article of claim 8, wherein the outer wall of the nozzle forms a recessed groove proximate the bottom edge, the recessed groove receiving a radially inwardly extending shoulder of the annular collar.

10. The article of claim 1, wherein the valve is in a closed position as the resiliently deformable walls are moved into a deformed position; and during reformation of the resiliently deformable walls from the deformed position, the valve is open to allow fluid flow from the collar void space into the main body.

11. The article of claim 10, wherein the valve is in a closed position after the resiliently deformable walls have moved to a reformed position from the deformed position.

12. The article of claim 1, wherein the first opening is discrete from the second opening.

13. The article of claim 12, wherein the first opening extends axially through the check valve housing.

14. The article of claim 12, wherein the second opening formed through the check valve housing includes an opening radially extending into the check valve housing and an axially extending inflation port forming a continuous passageway with the radially extending opening.

15. The article of claim 14, wherein the valve seals the inflation port during fluid flow out of the nozzle aperture.

16. The article of claim 1, wherein the collar void space defines a spiral-shaped fluid pathway between the exterior of the main body and the annular collar.

17. The article of claim 1, wherein a gap is defined along a length of at least one thread of the collar threads or at least one thread of the body threads.

18. An article for rinsing a user's nasal cavity comprising a main body defining a reservoir for receiving a liquid, the main body having resiliently deformable walls, an upper opening defined by a rim, and a plurality of body threads defined on a to portion of the main body;

a nozzle having an outer wall forming a tip and defining an aperture formed therein and further extending radially outward and downward to form a skirt ending at a terminal edge, an inner wall forming a fluid passageway in communication with the aperture and extending inside the outer wall, a nozzle void space formed between the outer wall and the inner wall, and an annular bead formed on an inner surface of the terminal edge of the outer wall;

a check valve in fluid communication with the nozzle enclosed within a valve housing, wherein the valve housing further defines a first opening, a second opening, and an annular groove in an outer surface of the valve housing;

a liquid delivery tube extending from the check valve into the reservoir that provides fluid communication between the reservoir and the check valve;

an annular collar including a plurality of collar threads threadingly engaged with the body threads to connect the annular collar to the main body; wherein a collar void space in fluid communication with the second opening is formed between the body threads and the collar threads when the body threads and the collar threads are engaged;

the annular bead is received into the annular groove to connect the nozzle to the check valve housing;

the first opening formed through the check valve housing allows fluid communication between the reservoir of the main body and the void space in the nozzle; and deformation of the resiliently deformable walls of the main body causes fluid in the cavity to flow through the first opening and into the nozzle void space to increase pressure in the nozzle void space; and the second opening formed through the valve housing allows fluid communication between an exterior of the main body and the reservoir of the main body; and after deformation of the resiliently deformable walls of the main body, the check valve allows air to flow from the collar void space into the reservoir via the second opening to return the resiliently deformable walls to an original position.

19. The article of claim 18, wherein reformation of the resiliently deformable walls of the main body after deformation causes the fluid in the nozzle void space to return to the cavity in the main body.

20. The article of claim 18 further comprising a valve associated with the second opening to selectively allow fluid to flow from an area exterior to the main body into the collar void space and into the reservoir;

wherein reformation of the resiliently deformable walls of the main body after deformation opens the valve to allow fluid to flow from the collar void space, through the second opening and the valve into the cavity.

21. The article of claim 18, wherein the outer wall of the nozzle is faceted in a form that comprises a plurality of stacked conical frustums of differing outer wall angles.

22. The article of claim 18, wherein the outer wall of the nozzle includes steps forming ridges on an outer surface of the outer wall, wherein each step has a larger average diameter than a step above it and the steps are configured to create a seal with a user's nostril.

23. The article of claim 22, wherein each step has a larger diameter at a bottom edge of the step than at a top edge of the step.

24. The article of claim 18, further comprising an annular collar having a top edge and a bottom edge and removably connectable with the rim of the main body, wherein the annular collar couples the nozzle and the check valve to the upper opening of the main body when the annular collar is connected with the rim, and the skirt of the nozzle above the terminal edge extends beyond the top edge of the annular collar.

* * * * *